US007952450B2

(12) United States Patent
Lau et al.

(10) Patent No.: US 7,952,450 B2
(45) Date of Patent: May 31, 2011

(54) MANUALLY ADJUSTABLE ATTENUATOR

(75) Inventors: Yuenie S. Lau, San Jose, CA (US); Anthony Denning, San Martin, CA (US)

(73) Assignee: OML, Inc., Morgan Hill, CA (US)

( * ) Notice: Subject to any disclaimer, the term of this patent is extended or adjusted under 35 U.S.C. 154(b) by 91 days.

(21) Appl. No.: 12/240,039

(22) Filed: Sep. 29, 2008

(65) Prior Publication Data

US 2010/0079224 A1 Apr. 1, 2010

(51) Int. Cl.
*H01P 1/22* (2006.01)

(52) U.S. Cl. ..... 333/81 B; 333/211

(58) Field of Classification Search ..... 333/81 B, 333/81 R, 209, 208, 211, 239, 248, 253, 157, 333/158, 159
See application file for complete search history.

(56) References Cited

U.S. PATENT DOCUMENTS 3,747,031 A * 7/1973 Ohm ..... 333/81 B
4,918,410 A * 4/1990 Beyer et al. ..... 333/24.2

* cited by examiner

*Primary Examiner* — Stephen E Jones
(74) *Attorney, Agent, or Firm* — Temmerman Law Office; Matthew J. Temmerman

(57) ABSTRACT

An improved manually adjustable wave attenuator for a waveguide comprises a resistive portion sandwiched between two dielectric portions. In a preferred embodiment the adjustable attenuator comprises a first card further comprising a dielectric portion and a resistive portion and a second dielectric card of substantially the same thickness as said first card, thereby minimizing the possibility of the resistive material coming into contact with and shorting to the resistive card opening, and reducing the required width of the card channel, while many of the problems regarding RF leakages that occur in conventional systems. Finally, more precisely centering the resistive material to the waveguide center is possible because process of affixing the two cards reduces warpage therein, and puts the resistive film symmetrically between the dielectric portions.

6 Claims, 13 Drawing Sheets

MANUALLY ADJUSTABLE ATTENUATOR

BACKGROUND

1. Field of the Invention

The present invention is related to electromagnetic waveguides, and particularly to an improved waveguide component comprising a manually adjustable attenuator.

2. Background of the Invention

Waveguides are used to guide and carry waves, such as electromagnetic, light, or sound waves. The type of waveguide used is dependent on the type of wave to be propagated. The most common waveguide design is a simple hollow metal conductor tube inside which travels a wave, eventually exiting and propagating outward and away from the exit point of the tube. Certain types of waveguides pass the wave through a specific medium, such types including air filled waveguides, dielectric filled waveguides, slot-line waveguides, and slot-based waveguides etc. Typical waveguides are made from materials such as brass, copper, silver, aluminum, or any other metal exhibiting low bulk resistivity.

Waveguides are becoming more commonly used in the millimeter wave and sub-millimeter wave industry, which generally includes frequencies above 30 GHz. This high frequency band of electromagnetic waves is more commonly becoming useful for many new products and services, such as high-resolution imaging systems, high-resolution radar systems, point-to-point communications and point-to-multipoint communications.

Reducing the amplitude of a wave is a common and generally simple practice in the waveguide industry. This is most conveniently and effectively accomplished through the use of adjustable attenuators for waveguides that serve to reduce the amplitude of the wave without distorting the waveguide passing therethrough. This is generally accomplished through an actuatable card or fin in insertable relation with the pathway of the waveguide, absorbing the propagation of the wave to a degree desired by the operator. The dissipative effectiveness of such a card or fin is at its greatest when the card or fin is positioned parallel to and at maximum depth within the strongest part of the electric field within the waveguide.

As is typical in industries that frequently require hardware miniaturization, the waveguide industry is encountering challenges associated with precisely machining the smaller and smaller waveguides and attenuators demanded by high frequency applications. Because in general, higher frequency waves require a smaller waveguide (and relatedly, waveguide attenuators construction), the problems associated with tolerances to which parts are machined in lower frequency installations are multiplied in higher frequency installations. That is, state of the art machining tolerance acceptable at low frequencies will become a major concern in parts made for operation at higher frequencies, particularly in the millimeter wave and sub-millimeter wave range. The accuracy at which an attenuator is constructed directly affects the attenuator's electrical performance.

3. Description of the Related Art

Adjustable attenuators were introduced in the 1950s and generally employed the basic resistive fin or card method as described above. In these systems, an opening is provided and the attenuation card is inserted therethrough and into the path of a wave propagating down a waveguide. Frequencies in use during the early phase of the industry were generally lower than those used today, and hence precision machining of parts and the critical placement of the card were not an issue then as it has become today.

As described above, the dissipative effect of the resistive card varies with the positioning of the card within the waveguide. Moving the card into and out of the guide or moving the fin between the maximum field region and a weak field region affects the amplitude of the wave-propagated therethrough. Conventionally, the card comprises a dissipative material such as a dielectric impregnated with carbon, or of a thin layer of carbon on a dielectric sheet. In more precise attenuators, conventional materials include such materials as a thin layer of metal such as nickel-chromium alloy on a glass sheet. See U.S. Pat. No. 2,890,424 (1955) and U.S. Pat. No. 2,830,275 (1958).

Over the decades that followed, the industry saw an increase in the frequencies commonly used, however, just minor changes to the basic design were sufficient to provide adequate attenuation for these increases. In some improved conventional systems, the resistive card is made very thin, given the capability to rotate, or made of exotic materials such as tantalum nitride resistive film deposited on sapphire or alumina substrates. Although these improvements led to a more flat frequency response and improved accuracy of attenuation as systems moved to the lower millimeter wave frequencies (approximately 50 GHz), they could not adequately respond to the problems occurring as the frequencies in use moved to the millimeter to sub-millimeter range and beyond. As frequency increases, waveguide structures must necessarily shrink, and the single card insert system began losing its viability as a manufacturing product in the lowest millimeter and sub-millimeter range.

FIGS. 1 and 2 is a diagram of a conventional manual vertical insertion adjustable attenuator. Referring first to FIG. 1, resistive card 1 is attached to a micrometer assembly 3. The micrometer assembly 3 is an actuator that pushes and pulls the resistive card 1 into the path of a waveguide channel 2. At one extreme the resistive card 1 is pushed to the bottom of waveguide channel 2. Spring 4 provides tension against the downward movement of micrometer assembly 3, and is kept in place with stopper 5. Screws 6 attach resistive card 1 to a nonconductive mounting block 7, which holds and positions the resistive card 1. Spring 4, stopper 5, screws 6, nonconductive mounting block 7 and resistive card 1 all compose a resistive card holder assembly 8, which holds and positions the resistive card 1 to the center of the waveguide channel 2. In addition, a housing 9 comprises the resistive cardholder assembly 8 and the waveguide channel 2.

FIG. 2 is a diagram of the conventional manual vertical insertion adjustable attenuator shown in FIG. 1, however, FIG. 2 is shown from a perspective looking down the length of waveguide channel 2. Resistive card 1 is also shown from a side perspective. The typical thickness of a resistive card in a conventional manually adjustable attenuator is 0.005". Importantly, resistive card 1 has a resistive surface 10. In operation, the micrometer assembly 3 pushes resistive card 1 into the path of the waveguide channel 2 through card channel 20. Card channel 20 must be wide enough to accommodate the thickness of resistive card 1, taking into account any card warping that may have occurred, and the sum of machining tolerance build-ups of all assembled parts. If card channel 20 is too narrow in a conventional system such as that shown in FIGS. 1 and 2, the card's resistive surface 10 may touch the side walls of card channel 20, effectively modifying the variable attenuation characteristics. Scratches or scrubbing on the resistive surface 10 as the resistive card 1 is traveling up and down the card channel 20 will also alter the desired attenuation response, and can even lead to binding.

The simple solution to the above problem (creating a wider card channel 20) causes excess ripples in the attenuator responses due to RF leakage into the resistive material holder assembly 8. Thus, as a current solution the industry largely handcrafts the resistive card to fit within the narrowest card channel possible without scraping or scrubbing. As typical wavelengths used continued to decreases and frequency continues to increase, the above problems are exaggerated.

At these higher frequencies, a second problem common in the conventional systems shown in FIGS. 1 and 2 relates to difficulty in precisely centering the resistive card within the waveguide channel. If the resistive card 1 is not precisely centered, the movement of the card into and out from the waveguide channel 2 causes the electromagnetic field associated therewith to be perturbed asymmetrically, since, the resistive card 1 has a dielectric medium on one side and air on the other. This leads to attenuation response variations and is amplified by the degrees of off centering as the resistive card travels down the waveguide channel. Again, the problems are made more dramatic as wavelength decreases and frequency increases.

Thus, the present application discloses an innovative manually adjustable attenuator for wave-guide use that provides improved attenuation response, particularly at the W band and above. In addition, the present invention offers improved centering of the resistive card in a waveguide channel. Finally, the present invention increases the ease of manufacturing of such adjustable attenuators.

SUMMARY OF THE INVENTION

The applicant's improved manually adjustable attenuator adds a second card to the conventional one card resistive card system, thereby sandwiching the resistive portion of a first card between two equal dielectric components. The adjustable attenuator comprises a first card further comprising a dielectric portion and a resistive portion and a second dielectric card of substantially the same width as said first card. This configuration prevents the possibility of the resistive material coming into contact with and shorting to the resistive card opening, and allows the use of a smaller width of the card channel, thereby mitigating many of the problems regarding RF leakages that occur in conventional systems. Finally, more precisely centering the resistive material to the waveguide center is possible because the process of affixing the two cards reduces warpage therein.

BRIEF DESCRIPTION OF THE FIGURES

The foregoing aspects and many of the attendant advantages of the invention will become more readily appreciated as the same becomes better understood by reference to the following detailed description, when taken in conjunction with the accompanying drawings, wherein.

DETAILED DESCRIPTION OF THE INVENTION

The following description is presented to enable a person of ordinary skill in the art to make and use various aspects and examples of the present invention. Exemplary descriptions of specific materials, techniques, and applications are provided. Various modifications to the examples described herein will be readily apparent to those of ordinary skill in the art, and the general principles defined herein may be applied to other examples and applications without departing from the spirit and scope of the invention. Thus, the present invention is not intended to be limited to the examples described and shown, but is to be accorded the scope consistent with the appended claims.

Waveguide attenuators reduce the amplitude of a wave traveling through a waveguide. There is always some level of wave distortion due to reflection of the wave, but the amount of distortion should be minimized and ideally is zero. Like conventional adjustable attenuators, the present system employs a resistive card or fin (hereinafter referred to as a card) into the pathway of the waveguide, partially absorbing and thereby reducing the amplitude and energy of the wave therein. Ideally, the card element is proportioned to permit the card to be inserted in the waveguide to provide an energy loss without introducing any reflection. Finally, the adjustable attenuator should provide, ideally, the same attenuation over a wide frequency band.

Figure 3:
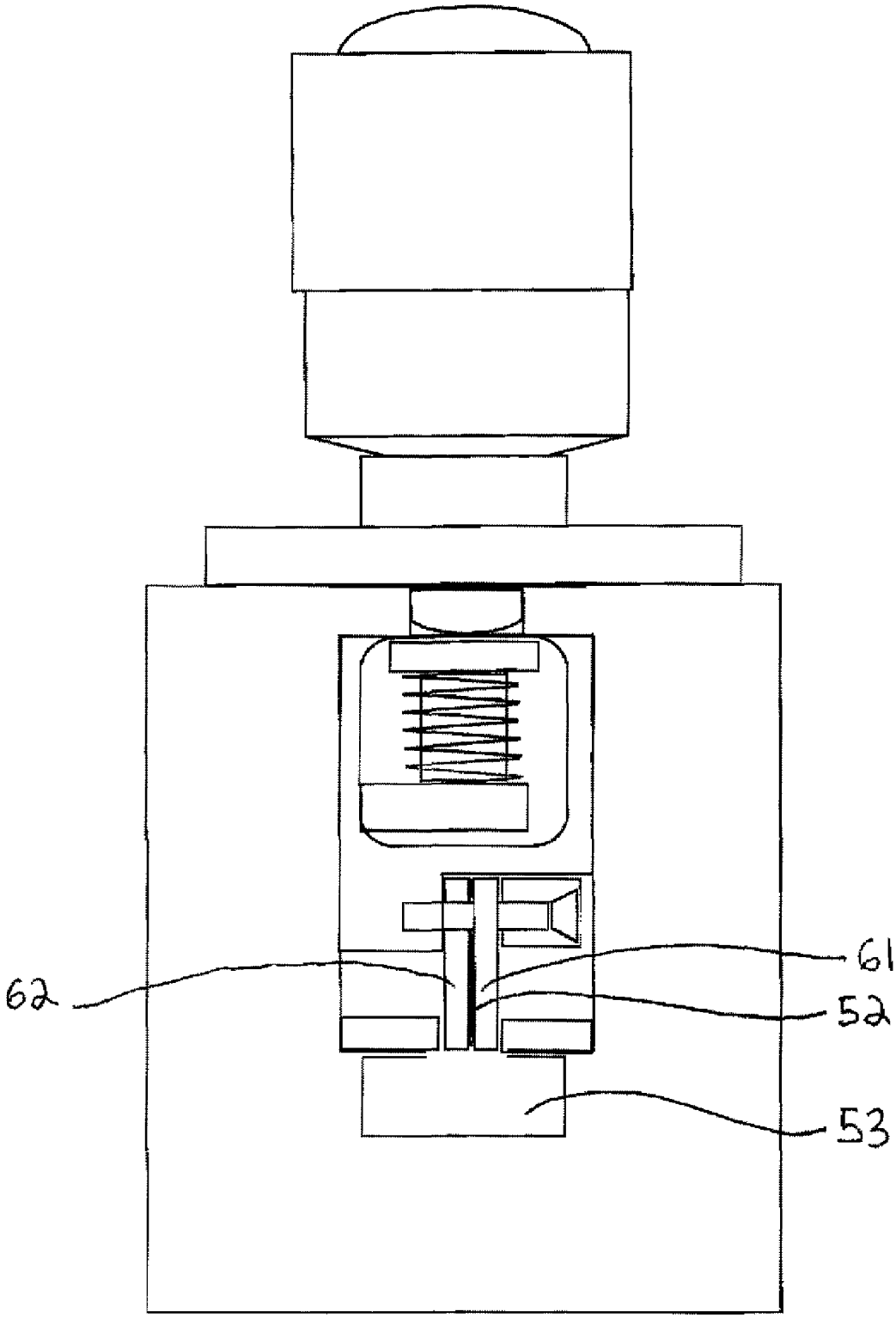
FIG. 3 is a diagram of a side view of the improved manually adjustable attenuator according to the present invention.

As in most conventional designs, the applicant's improved adjustable attenuator design utilizes an absorber for insertion into a section of waveguide. Referring to FIG. 3, the absorber (card) comprises a first dielectric card 61 that is parallel both to the E field and to the direction of propagation of energy along the waveguide. Abutting this first card is a second dielectric card 62 of substantially the same material. Between these two cards is a thin resistive material 52.

While the conventional single card systems employ a card having a resistive side and a dielectric side, the present invention adds a second card of generally the same thickness as the first. The second dielectric card 62 preferably abuts the resistive side of the first dielectric card 61, effectively sandwiching the resistive material 52 within two dielectric materials on each side thereof. Therefore, the resistive material 52 cannot contact, scratch, or scrub along the card channel. In practice, it is easiest to use identical dielectric cards wherein one card (in this exemplary case, the first dielectric card 61) has a very thin resistive coating thereon. Thus in practice the overall thickness of the two cards, considering the thin coating, is substantially similar.

Because there is no risk of shorting to the sides of improved card channel 53, narrower card channels than could have been used in the past may presently be employed. Since a narrower card channel reduces the RF leakages that influence the attenuation characteristics, thinner resistive and dielectric materials can further narrow the card channel.

Finally, in the preferred structure (two cards, affixed together as described below), ease of centering the resistive material to the waveguide center is improved because the preferred method of pressing and gluing the two card components together removes any curvatures and non-planar components from the cards, thereby mitigating the aforementioned problems associated with warpage (i.e., the two cards may be pressed and glued to remove any curvatures in the materials).

As an exemplary method of manufacture, a first card comprises a biaxially-oriented polyethylene terephthalate (bo-PET) polyester film such as Mylar® that is thinly coated on one side with a material exhibiting electrical resistance, in this preferred method through lamination. A second card of only Mylar® but having an overall thickness generally equal to the first card is placed abutting the resistive side of the first card. Other compositions that exhibit dielectric characteristics, such as photo resist, may be used in place in of Mylar®. The two cards may be mechanically held in place during operation of the adjustable attenuator by a clamp, or may be glued together before operation. In this preferred exemplary embodiment, the gluing method is used due to slight warping and stress that may occur if the two card components are clamped together too tightly. The glue should preferably be a liquid low viscosity adhesive. In this preferred exemplary embodiment, the two cards have a width substantially equal with one another.

Figure 4:
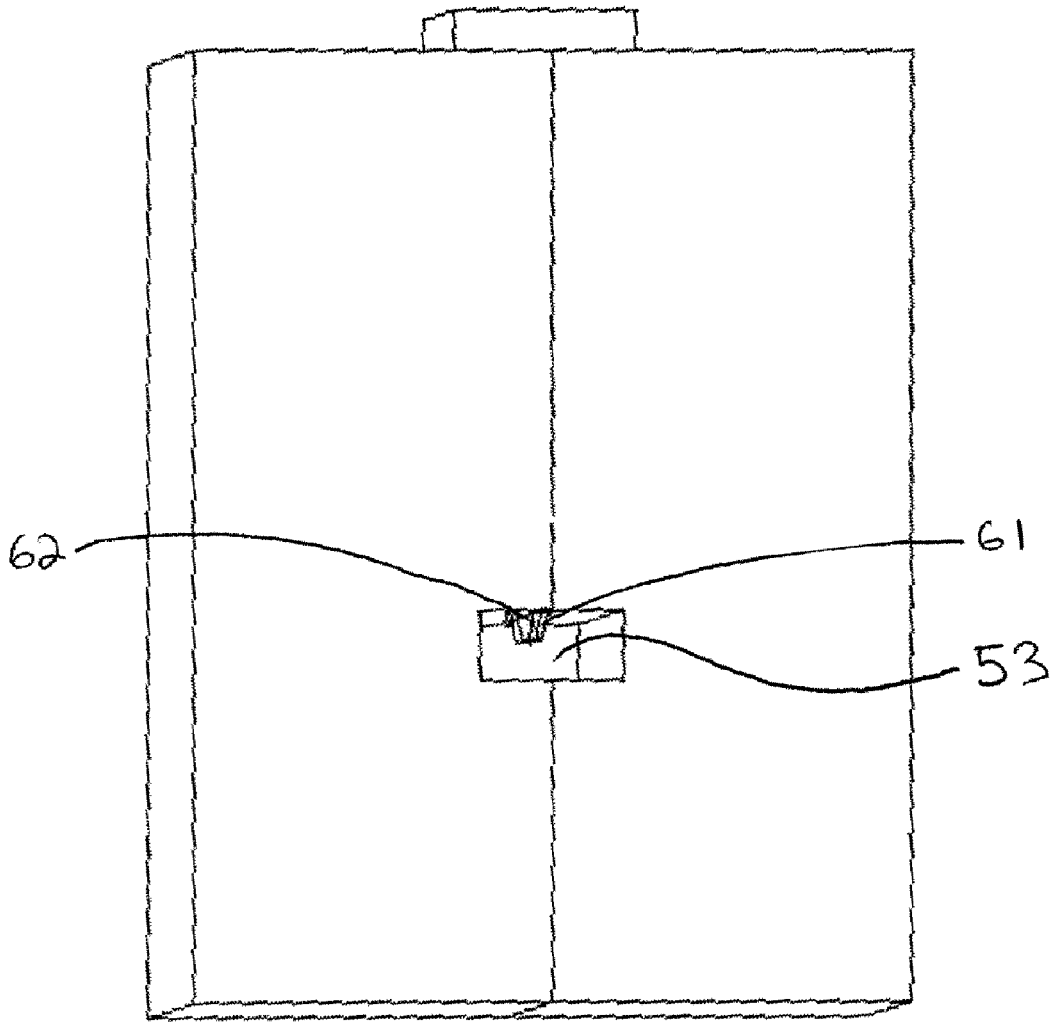
FIG. 4 depicts a first perspective view of an alternative embodiment of the adjustable attenuator according to the present invention.
Figure 5:
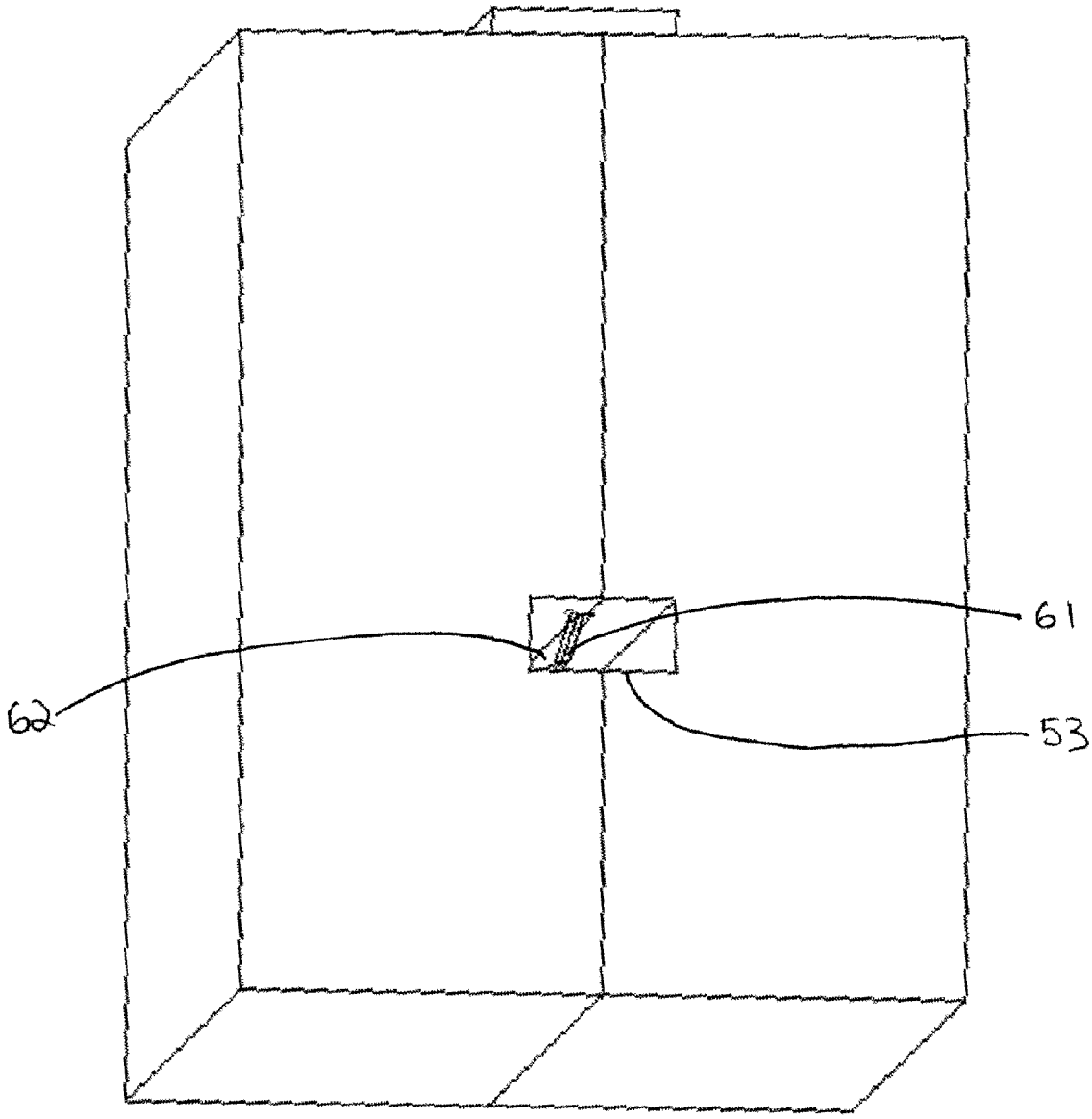
FIG. 5 depicts a second perspective view of the alternative embodiment of the adjustable attenuator according to the present invention.

An alternative embodiment of the two-card system showing both dielectric cards 61 and 62 as well as improved card channel 53 is depicted in FIGS. 4 and 5. This device shown in these two figures is a simplified diagram that omits many other components to ease understanding.

The two-card system described herein improves ease of manufacturing and electrical performance repeatability of attenuation response. Typically, to minimize RF leakage through a wide card channel, the card channel must be fine tuned through trial and error for each adjustable attenuator. This method takes away from the repeatability of the system. Under the system disclosed herein, there is no risk of shorting between the resistive card and sidewalls of the card channel. Therefore, the channel may be manufactured very narrowly and does not require any trail and error adjustments before use.

Figure 1:
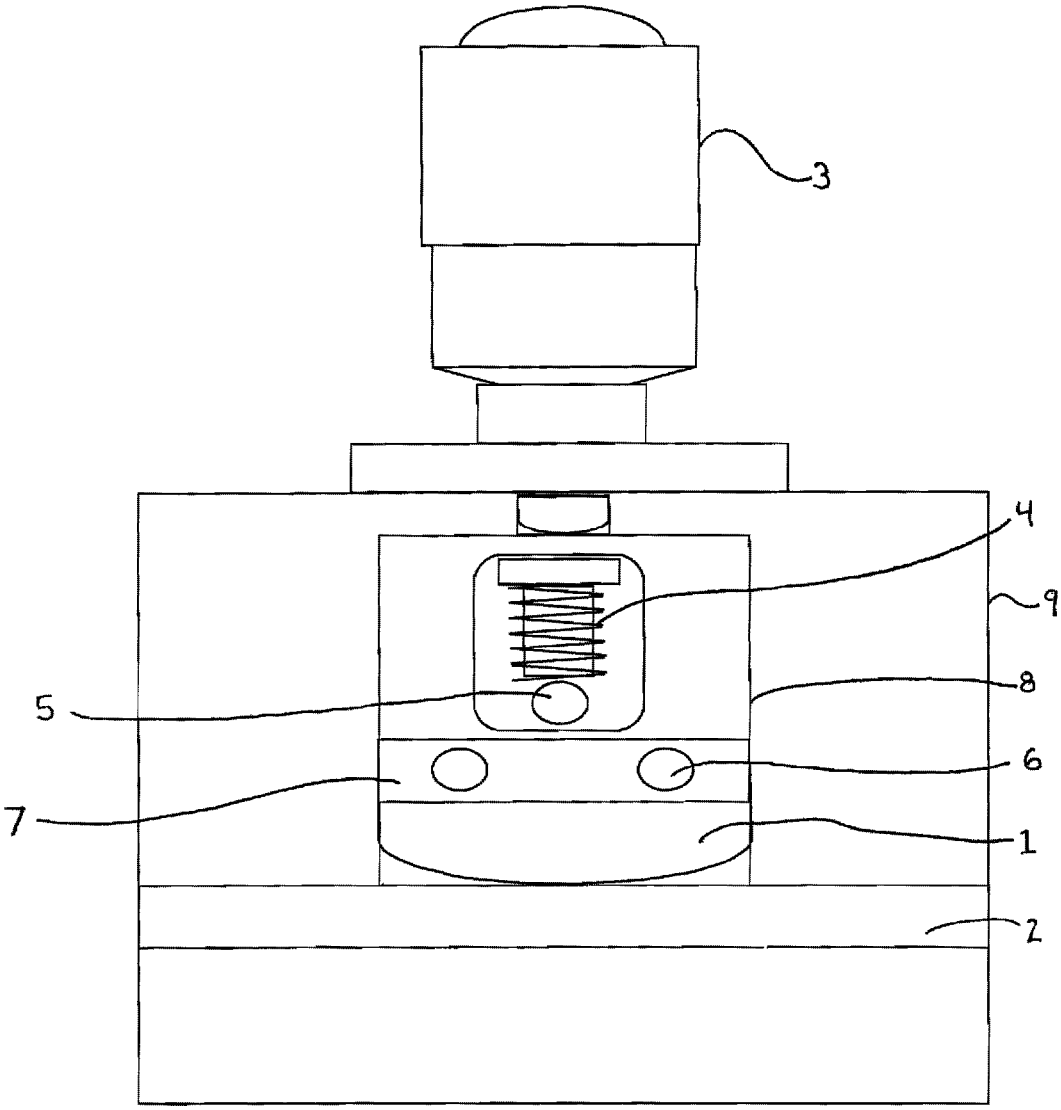
Fig. 1 (PRIOR ART)
FIG. 1 is a diagram of a front planar view of a conventional manually adjustable attenuator.
Figure 2:
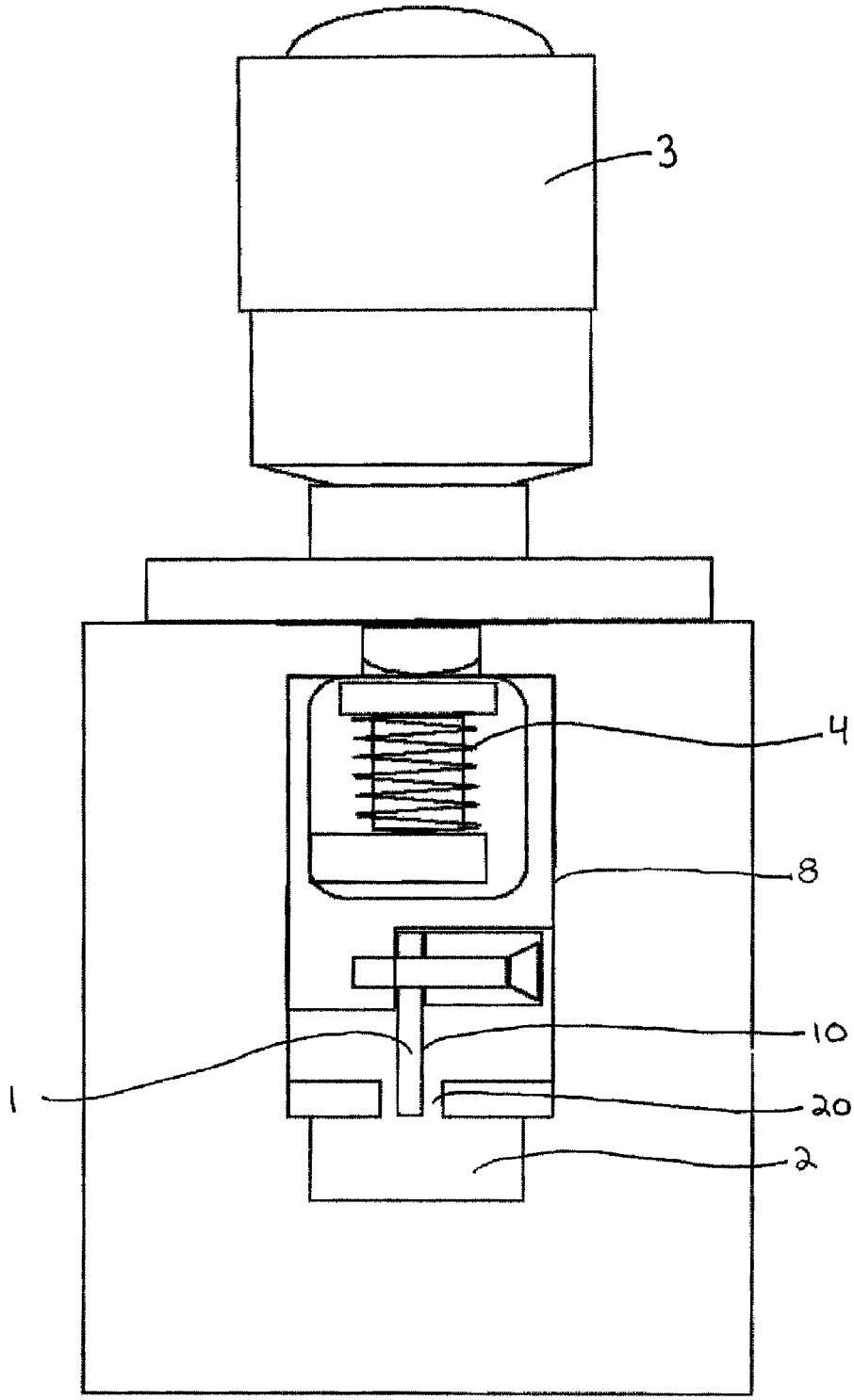
Fig. 2 (PRIOR ART)
FIG. 2 is a diagram of a side planar view of a conventional manually adjustable attenuator.

Attenuation response is vastly improved over conventional adjustable attenuators currently in use. The remaining figures show these improvements. FIGS. 6, 7, 8, and 9 are the data from four test runs of a conventional asymmetric resistive card design adjustable attenuator currently in use. These results are thus from a design similar to the design diagrammed in FIGS. 1 and 2. FIGS. 10, 11, 12, and 13 are data from four test runs of the improved card design disclosed herein.

Each line in each of the eight data charts represents the amount of attenuation (in dB) across a spectrum (65-110 GHz) for a given amount of absorption in the propagation path by the attenuator. For instance, in FIG. 6, there is very little to no attenuation until the resistive card is adjusted from a starting position by distance of at least 150 units. Attenuation levels are likewise shown with the resistive card is adjusted from the starting position by 200, 225, 250, 275, 285, 295, and 305 units. Accordingly, the further the resistive card is moved from its starting position, the more absorption of the wave occurs, and the greater the reduction of signal.

Figure 6:
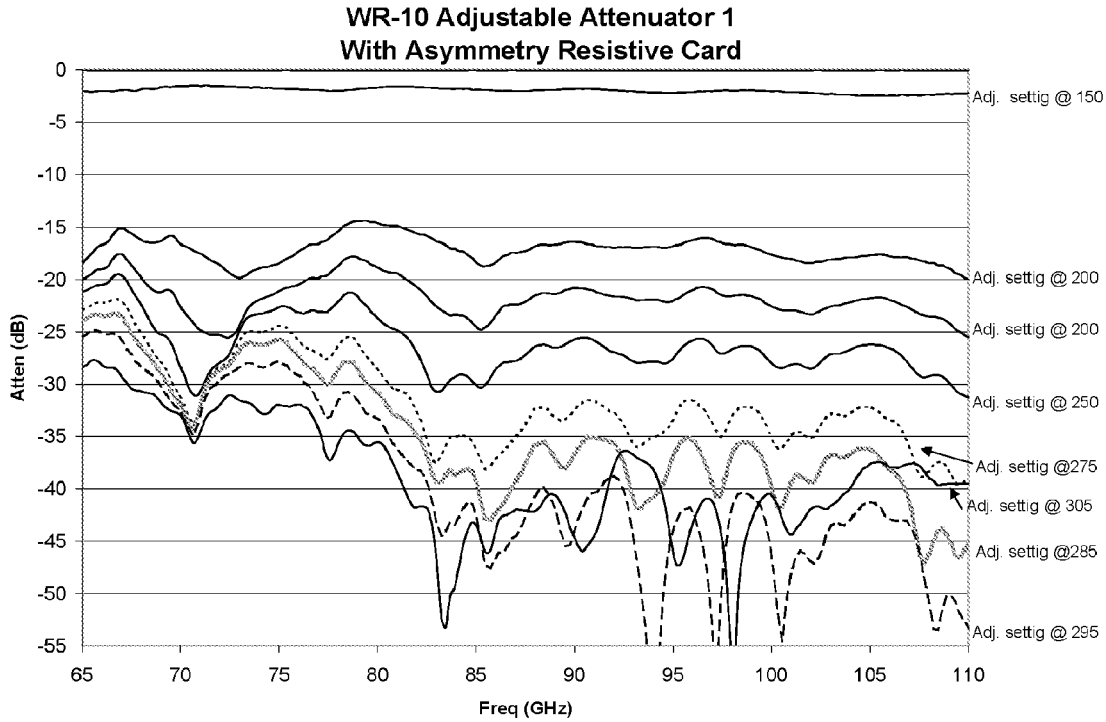
Fig. 6 (PRIOR ART)
FIG. 6 is a data plot showing a first set of data for a conventional adjustable attenuator with asymmetric resistive card.
Figure 7:
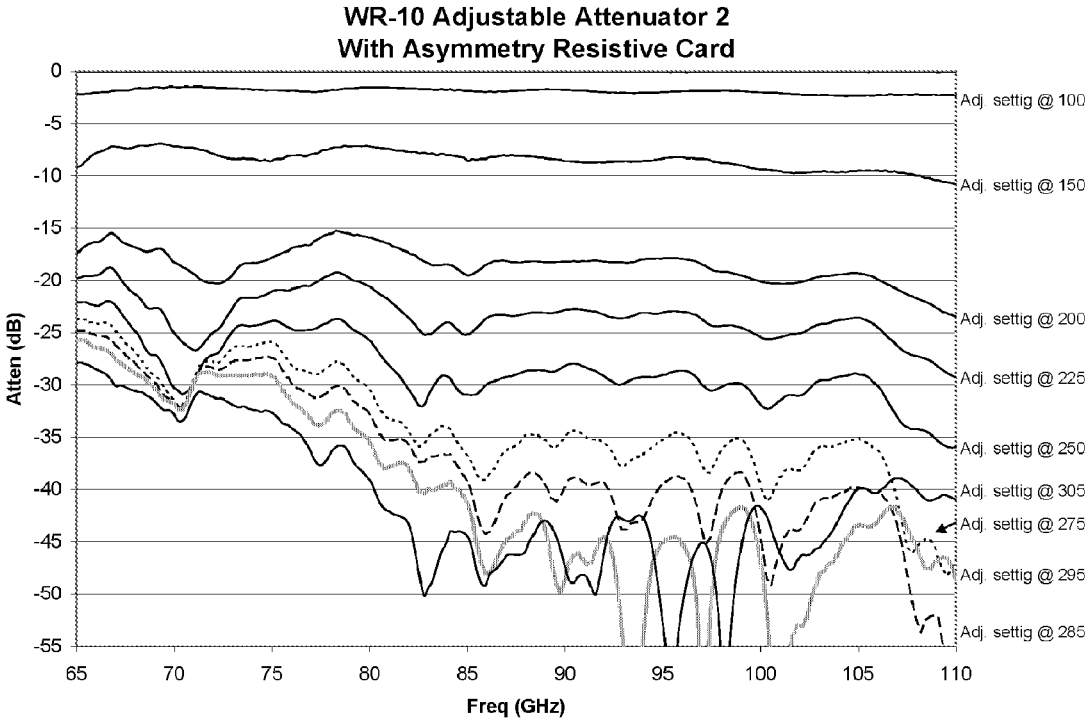
Fig. 7 (PRIOR ART)
FIG. 7 is a data plot showing a second set of data for a conventional adjustable attenuator with asymmetric resistive card.
Figure 8:
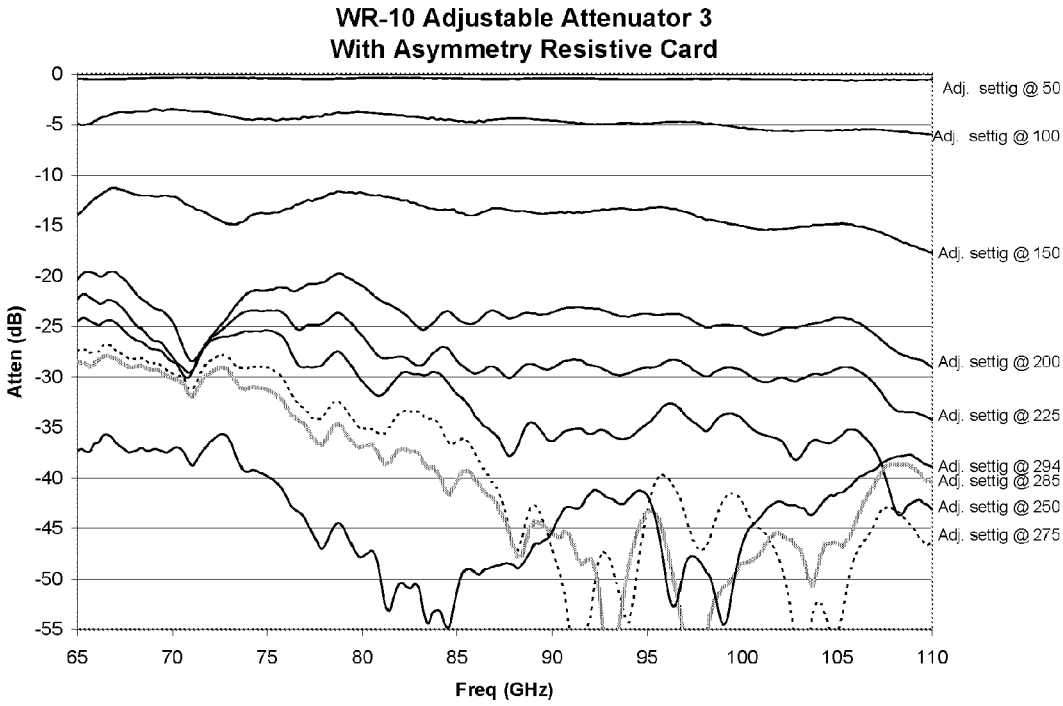
Fig. 8 (PRIOR ART)
FIG. 8 is a data plot showing a third set of data for a conventional adjustable attenuator with asymmetric resistive card.

Continuing on with FIG. 6, but also with FIGS. 7 and 8, irregularities and ripples are seen in all of the lines where significant attenuation is occurring. It should be noted here that the greater the absorption of the wave by the resistive card, the greater the amplitude of the ripples. This is a result of the asymmetry of the resistive card design and its ability to maintain a true electrical and mechanical center with respect to the center of the waveguide. The acute ripples present in FIGS. 6 and 7 above a setting of 275 units and in FIG. 8 above a setting of 265 units are likely due to RF leakage into the resistive card holder cavity due to the card not being perfectly centered therein. The monotonicity displayed in FIG. 8 at a setting of 294 units is due the presence of the asymmetric resistive card, and specifically to RF leakage through the resistive card holder cavity and back out through the other side of the resistive card.

Figure 9:
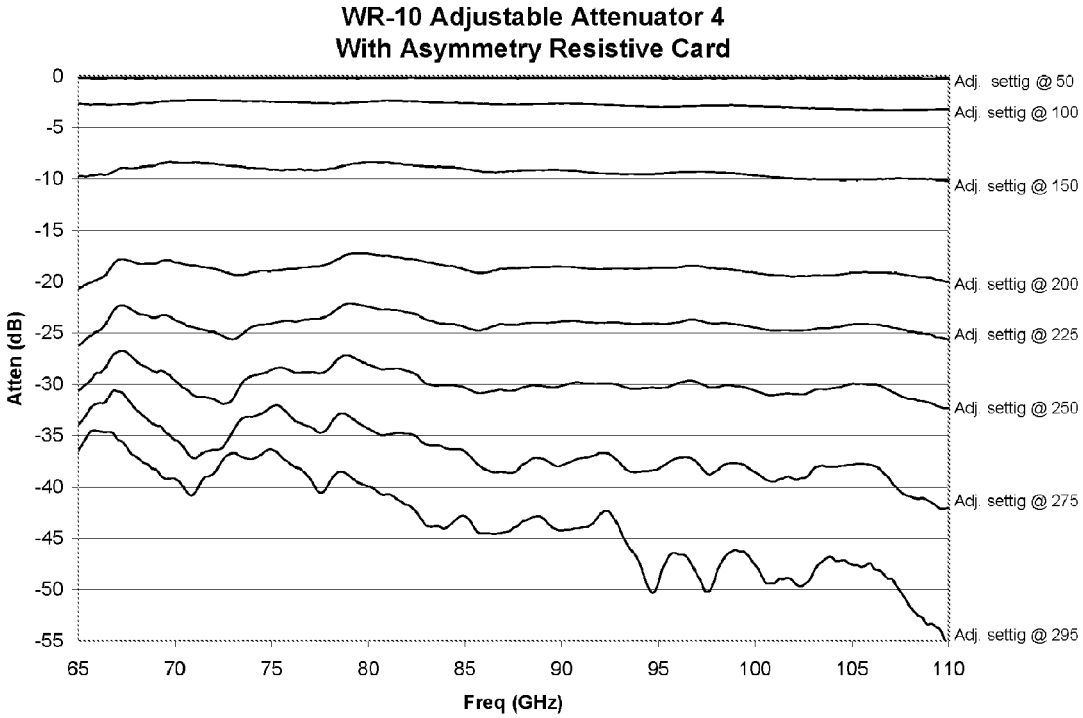
Fig. 9 (PRIOR ART)
FIG. 9 is a data plot showing a fourth set of data for a conventional adjustable attenuator with asymmetric resistive card.
Figure 10:
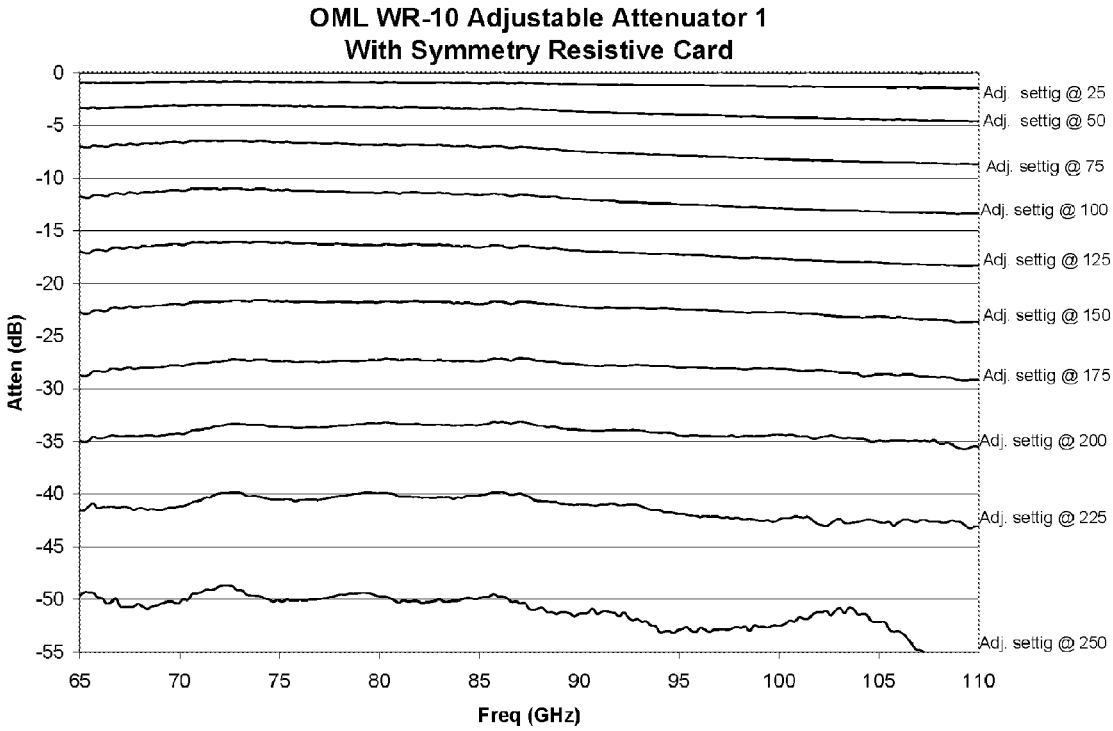
FIG. 10 is a data plot showing a first set of data for the adjustable attenuator according to the present invention.
Figure 11:
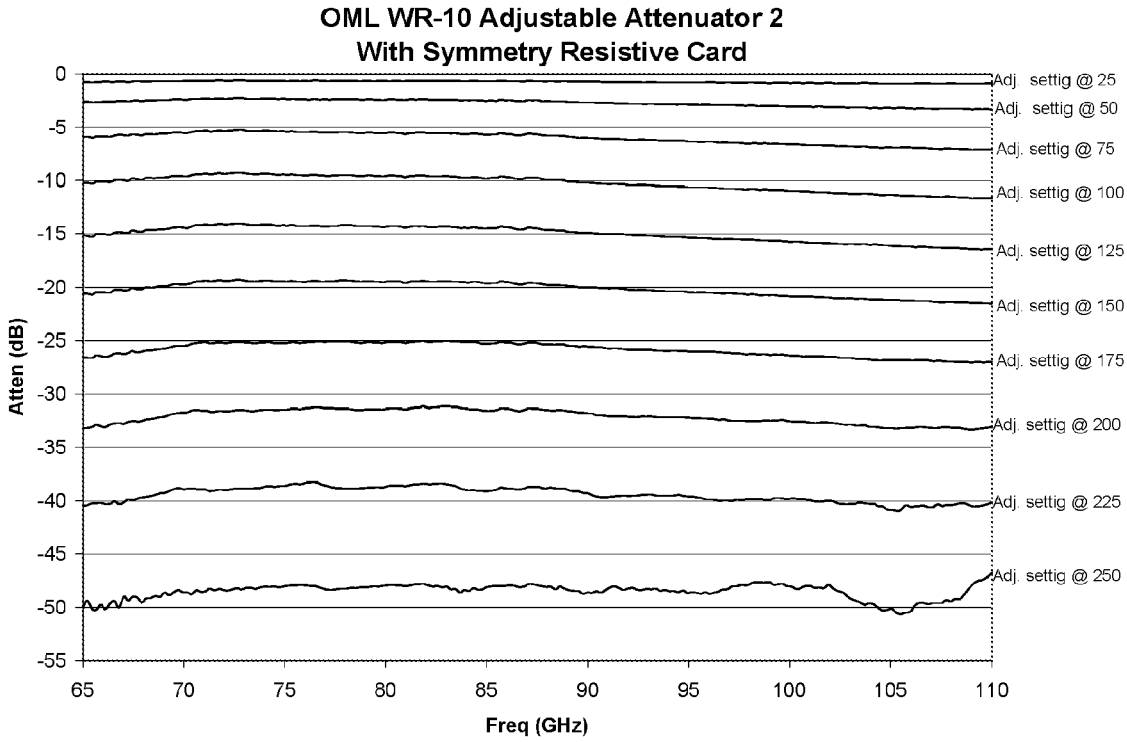
FIG. 11 is a data plot showing a first set of data for the adjustable attenuator according to the present invention.
Figure 12:
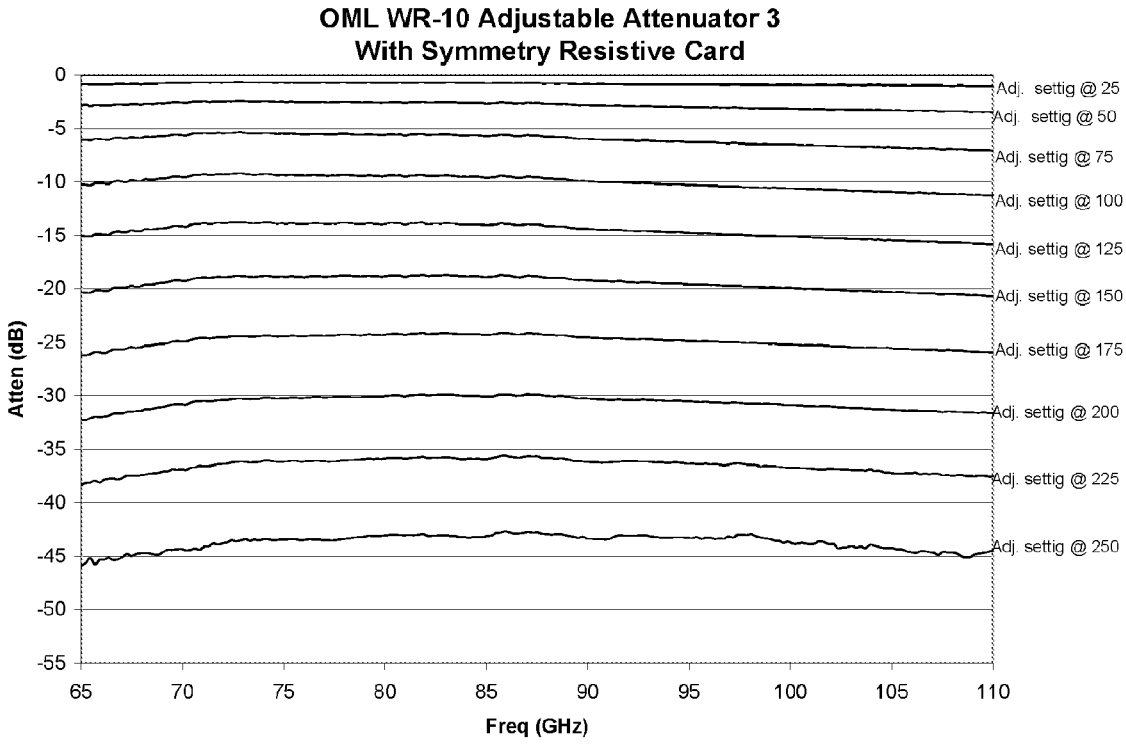
FIG. 12 is a data plot showing a first set of data for the adjustable attenuator according to the present invention.
Figure 13:
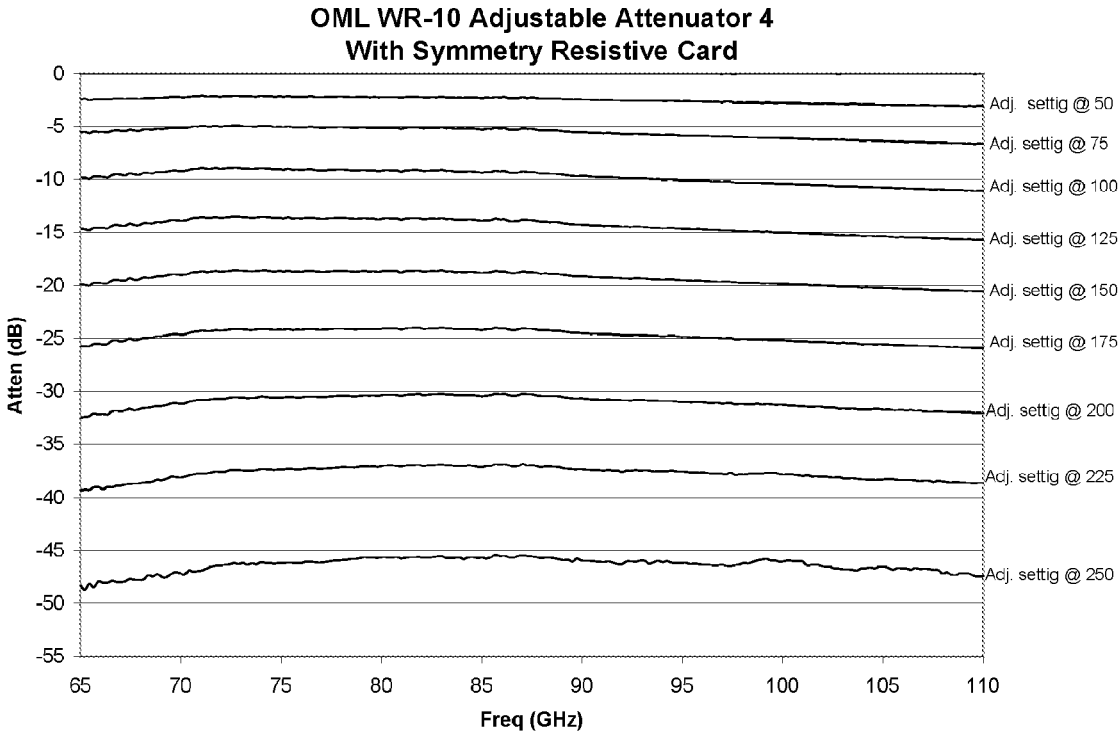
FIG. 13 is a data plot showing a first set of data for the adjustable attenuator according to the present invention.

The best results obtained through trial and error procedures of centering the resistive card to the center of the waveguide are shown in FIG. 9. This chart is considered a best-case scenario using known manufacturing techniques. Although the irregularities are reduced, they are still present, particularly at greater attenuation levels.

Test results from four attenuators manufactured according to the preferred embodiment described herein are present in FIGS. 10-13. These plots show a dramatic mitigation of the problems present in the standard attenuation plots due the benefits previous described.

With respect to the above description then, it is to be realized that material disclosed in the applicant's drawings and description may be modified in certain ways while still producing the same result claimed by the applicant. Such variations are deemed readily apparent and obvious to one skilled in the art, and all equivalent relationships to those illustrated in the drawings and equations and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact disclosure shown and described, and accordingly, all suitable modifications and equivalents may be resorted to, falling within the scope of the invention.

The invention claimed is:

1. A waveguide assembly for reducing the amplitude of an electromagnetic wave, the assembly comprising:

a. a section of waveguide through which propagates a wave; and b. an adjustable absorber for attenuating said wave, said absorber substantially centered in said waveguide and comprising a first dielectric portion parallel to the E field and to the direction of propagation, a second dielectric portion parallel to the E field, and a resistive portion sandwiched between said dielectric portions.

2. The adjustable attenuator according to claim 1 wherein said resistive portion is in direct mechanical contact with said dielectric portions.

3. The adjustable attenuator according to claim 2 wherein said resistive portion and said dielectric portions make up a resistive card.

4. The adjustable attenuator according to claim 3 wherein said resistive card is positioned parallel to an electric field and direction of propagation within said waveguide.

5. The adjustable attenuator according to claim 3 wherein said resistive card is in actuatable relation with said waveguide.

6. The adjustable attenuator according to claim 5 wherein said resistive card is positioned parallel to an electric field and direction of propagation within said waveguide.

* * * * *